United States Patent [19]

Holmér

[11] Patent Number: 4,777,916

[45] Date of Patent: Oct. 18, 1988

[54] VALVE SPRING DEVICE FOR A VALVE IN AN INTERNAL COMBUSTION ENGINE

[75] Inventor: Ernst Holmér, Göteborg, Sweden

[73] Assignee: AB VOLVO, Gothenburg, Sweden

[21] Appl. No.: 104,231

[22] Filed: Oct. 5, 1987

[30] Foreign Application Priority Data

Oct. 20, 1986 [SE] Sweden ..... 8604460

[51] Int. Cl.[4] ..... F01L 3/10

[52] U.S. Cl. ..... 123/90.67; 123/188 SC

[58] Field of Search ..... 123/90.65, 90.66, 90.67, 123/188 SA, 188 SC

[56] References Cited

U.S. PATENT DOCUMENTS

| | | | |
|---|---|---|---|
| 1,331,826 | 2/1920 | Shepherd | 123/90.66 X |
| 2,595,775 | 5/1952 | Wrangell | 123/90.12 |
| 3,094,976 | 6/1963 | May | 123/90.67 X |
| 3,301,239 | 1/1967 | Thauer | 123/90.67 X |
| 4,602,598 | 7/1986 | Moore | 123/90.67 |

FOREIGN PATENT DOCUMENTS

| | | | |
|---|---|---|---|
| 2949413 | 6/1981 | Fed. Rep. of Germany | 123/188 SC |

*Primary Examiner*—Willis R. Wolfe

*Attorney, Agent, or Firm*—Young & Thompson

[57] ABSTRACT

The invention relates to a valve spring device for a valve in an internal combustion engine. The valve has a valve disc (4) cooperating with a valve seat (5) to control the flow in an engine duct (3), and a valve spindle (6) extending from the valve disc (4). The valve spring device comprises at least one spring (10,11) which is arranged to act between an abutment surface (12) of the engine and an actuating device (8) joined to the valve spindle (6) to bias the valve disc (4) towards the valve seat (5). According to the invention the spring (10,11) consists of a relatively weak helical compression spring. The actuating device (8) is arranged around the valve spindle (6) and is axially displaceable and sealingly guided to form a chamber (15), which at one end is limited by the abutment surface (12) and at the other end is limited by the actuating device (8). The chamber (15) is in communication (24–27) with the engine duct (3) in which the valve (4,6) is arranged to control the flow.

3 Claims, 2 Drawing Sheets

VALVE SPRING DEVICE FOR A VALVE IN AN INTERNAL COMBUSTION ENGINE

Figure 1:
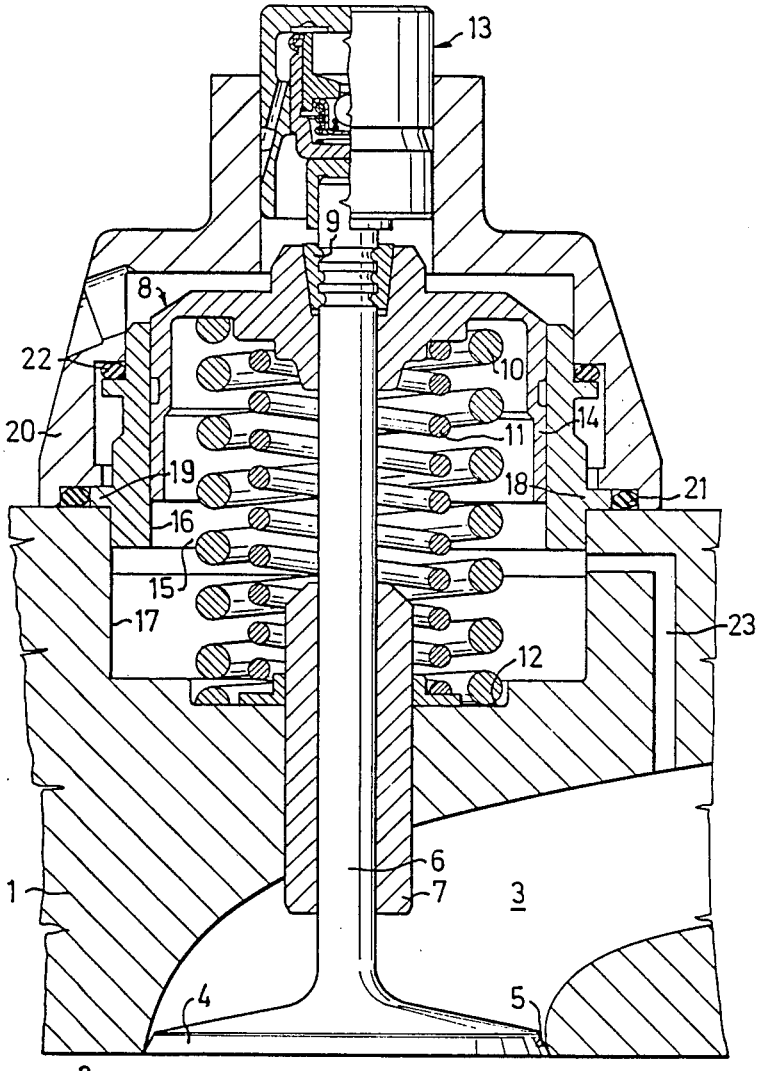

The invention relates to a valve spring device for a valve in an internal combustion engine, said valve having a valve disc which cooperates with a valve seat to control the flow in a duct in the engine, and a valve spindle extending from said valve disc, the valve spring device comprising at least one spring arranged to act between an abutment surface of the engine and an actuating means joined to the valve spindle to bias the valve disc towards the valve seat.

Valves with valve spring devices of the above mentioned type are generally used as intake and exhaust valves in internal combustion engines. Usually the valve is closed solely by means of the spring, and the valve is opened under the influence of a mechanical valve mechanism. Present development trends in internal combustion engines are, however, towards increased power and efficiency and this means that the valve spring devices of the above mentioned type under certain circumstances do not provide completely satisfactory performance.

One situation where the known valve spring devices do not function satisfactorily is in supercharged engines with high boost pressure. In modern engines, e.g. diesel engines used in trucks and the like, the boost pressure can be increased to levels which could give rise to mechanical damage to the engine. Early closing of the intake valve during the intake stroke produces an expansion of the air in the cylinder resulting in lower temperature and pressure. The emission of toxic nitrogen oxides is thereby reduced at the same time as a higher thermal efficiency is achieved. In order to prevent the intake valve from opening under the influence of the pressure in the intake duct when the pressure in the cylinder is low, very strong valve springs must be used. It can be difficult with the space available, to fit in sufficiently strong valve springs with low mass to limit the dynamic forces as the valve moves. In this context the disadvantage should also be mentioned that if there is any risk that the valve will open as a result of the pressure in the duct, it is not possible to use hydraulic valve tappets in the valve mechanism, which otherwise would be desirable for eliminating play in the valve mechanism and for reducing the noise level. If the valve should open without the valve mechanism being actuated, this would be sensed by a hydraulic valve tappet as though there were play in the valve mechanism and it would expand to eliminate this play. The hydraulic valve tappet cannot thereafter return to its original position and this would make it impossible for the valve to close, which is of course entirely unacceptable.

Another case, which will give rise to the same problem as described above in connection with an intake valve in a combustion engine with high boost pressure, has to do with the exhaust valves in an engine with exhaust braking. The exhaust brake consists of a valve in the engine exhaust system. The valve is closed to achieve a powerful engine braking effect. This creates a high pressure in the exhaust system between the exhaust brake valve and the engine exhaust valve. If this pressure is sufficiently high, it can cause the exhaust valve to open against the effect of the valve spring. This will produce the same disadvantages as described above.

The purpose of the invention is to achieve a valve spring device which removes the above mentioned disadvantages and makes it possible to achieve satisfactory functioning of the valve and the valve spring device under all conditions, i.e. even for an intake valve in an engine with high boost pressure and early closing of the intake valve and for an exhaust valve in an engine with exhaust braking. This should be achieved without using such excessive forces in the valve springs that problems with space and inertial forces arise. This is achieved according to the invention by means of a valve spring device of the type described by way of introduction which is characterized in that the spring is a helical compression spring of relatively weak spring force and that the actuating means is arranged around the valve spindle and is axially displaceable and sealingly guided to form an essentially cylindrical chamber, which at one end is delimited by the spring abutment surface and at the other end by the actuating means, said chamber communicating via at least one connecting path with the engine duct in which the valve is arranged to control the flow.

Figure 2:
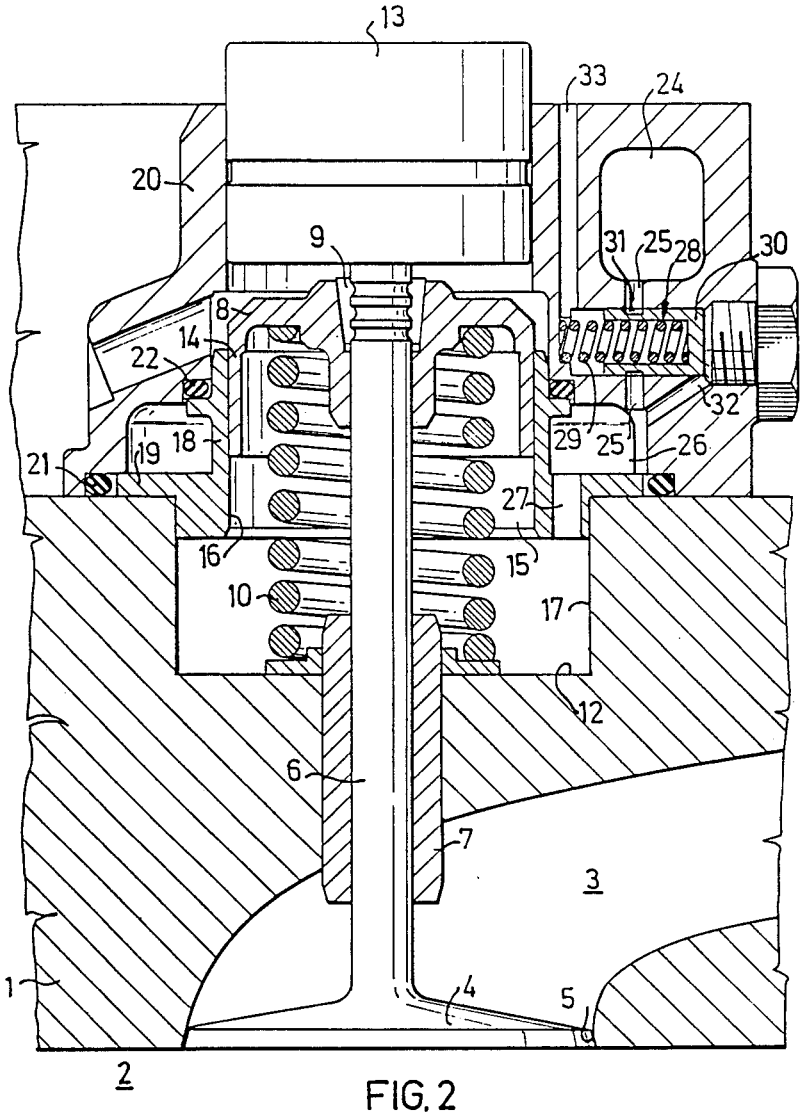

The invention will be described in more detail below with reference to the accompanying drawing of which FIG. 1 shows a section through a portion of a combustion engine with a valve and a valve spring device according to one embodiment of the invention, and FIG. 2 shows a section corresponding to FIG. 1 but relating to another embodiment of the invention.

FIG. 1 shows a section through a portion of a combustion engine, namely a portion of the engine head 1, delimiting one end of a cylinder 2 in the engine. In the portion of the head 1 shown, there is a duct 3, which can be either an intake duct or an exhaust duct, in communication with the cylinder 2. The communication is regulated by means of a valve with a valve disc 4, which seats against a valve seat 5 in the engine head 1. The valve also has a valve spindle 6 extending from the valve disc 4 through a valve guide 7 in a wall in the duct 3 and extending out past the end of the valve guide 7 facing away from the duct 3.

At the free end of the valve spindle 6 there is an actuating means 8 in the form of a valve spring cup fixed to the spindle with the aid of fastening means 9. Between the actuating means 8 and the head 1 there are two valve springs 10 and 11 in the form of helical compression springs. One end of each valve spring 10 and 11 abuts against the inside of the actuating means 8 and the other end of each spring abuts against a support surface 12 of the head 1 on the outside of the wall defining the duct 3. The valve springs 10 and 11 are made so that they achieve a relatively small closing force on the valve spindle 6 and the valve disc 4. This force is not sufficient to provide satisfactory operation of the valve under all conditions. The action of the valve springs 10 and 11 is augmented, however, in a manner which will be described in more detail below. The valve 4,6 is opened by means of a valve mechanism, of which only a valve tappet 13 is shown in the drawing.

The valve spring cup or actuating means 8 is made with an axially directed essentially cylindrical portion 14, which is axially displaceably arranged in a cylindrical chamber 15 and is sealingly guided against the cylindrical wall 16 of the chamber. In this manner, the valve spring cup 8 forms the end of the chamber 15, while the other end of the chamber 15 is the abutment surface 12 on the engine head 1. The chamber 15 is delimited laterally, not only by the cylindrical wall 16 but also by an essentially cylindrical wall portion 17 in a cavity, the bottom of which is the abutment surface 12.

The cylindrical wall 16 is made on the inside of a sleeve 18, which is inserted into the cavity and is provided with a flange 19 which is clamped by means of a cap 20 against the engine head 1. The sleeve 18 is made so that its one end fits into the cavity to center the sleeve 18. Suitable sealing means 21 and 22 are arranged between the various components to achieve the required seal.

The chamber 15 and the duct 3 are in open communication with each other through a channel 23 in the engine head 1, which means that the pressure in the chamber 15 will essentially follow the changing pressure in the duct 3. The pressure in the chamber 15 then acts against the inside of the valve spring cup or actuating means 8, which is thereby subjected to a force acting in the same direction as the force from the valve springs 10 and 11 and with a strength determined by the pressure in the duct 3. As was mentioned above, it is desirable to have an increased closing force on the valve 4,6 when the pressure in the duct 3 is high so as to prevent the valve from opening as a result of the high pressure in the duct. With the device described above, the forces acting on the valve are balanced because the force acting on the valve disc 4 as a result of the pressure in the duct 3 is counteracted by the force against the valve spring cup or actuating means 8 as a result of the pressure in the chamber 15. There is thus no risk of the valve disc 4 being pushed away from the valve seat 5 by high pressure in the duct 3.

FIG. 2 shows another embodiment of the invention which differs from the embodiment according to FIG. 1 only as regards certain details, and those components which are identical to those described in connection with FIG. 1 have been given the same reference numerals and will not be described in more detail here.

In the embodiment according to FIG. 2, the chamber 15 is not in direct communication with the duct 3. The duct 3 is instead, by means of a channel (not shown), in communication with an equalizing chamber 24, which can also be in communication with other ducts corresponding to duct 3 to other engine cylinders. The chamber 24 is connected via a channel 25 to an annular channel 26 between the cap 20 and the sleeve 18, which annular channel 26 is in open communication via a channel 27 with the chamber 15. In the channel 25 there is a pressure-limiting valve 28 with a spring-actuated valve body 30, which in the open position shown has a groove 31 in alignment with the channel 25, so that there is free communication between the equalizing chamber 24 and the annular channel 26. If the pressure in the annular channel 26 increases, however, this pressure will act on the end surface of the valve body 30 via a channel 32, so that said body at a predetermined pressure will be forced to the left in the drawing against the action of the spring 29, so that the groove 31 will be moved away from the channel 25, thus breaking the communication between the equalizing chamber 24 and the annular channel 26. A further channel 33 providing communication between the space to the left of the valve body 30 and the outside air sees to it that no pressure can be built up on this side of the valve body 30.

The device shown in FIG. 2 functions essentially as was described in connection with the embodiment according to FIG. 1 with the exception that the equalizing chamber 24 makes it possible to even out pressure variations arising in the duct 3, so that they are not transferred in their full extent to the chamber 15. The pressure-limiting valve 28 makes it also possible to limit the pressure in the chamber 15 to a desired value.

The invention described above can be applied to intake and exhaust valves in internal combustion engines to remove the problems described in the introduction to the description. The invention is of course not limited to the embodiments described above. Rather, changes can be made within the scope of the following patent claims. For example, it can be suitable in many cases to arrange a filter in the communication between the duct 3 and the chamber 15 to prevent impurities from penetrating into the chamber 15.

I claim:

1. Valve spring device for a valve in an internal combustion engine, said valve having a valve disc (4) which cooperates with a valve seat (5) to control the flow in a duct (3) in the engine, and a valve spindle (6) extending from said valve disc (4), the valve spring device comprising at least one spring (10,11) arranged to act between an abutment surface (12) of the engine and an actuating means (8) joined to the valve spindle (6), to bias the valve disc (4) towards the valve seat (5), characterized in that the spring (10,11) is a helical compression spring of relatively weak spring force and that the actuating means (8) is arranged around the valve spindle (6) and is axially displaceable and sealingly guided to form an essentially cylindrical chamber (15), which at one end is delimited by the spring abutment surface (12) and at the other end by the actuating means (8), said chamber (15) continuously communicating at all pressures in the engine duct below a predetermined maximum pressure via at least one connecting path (24–27) with the engine duct (3) in which the valve (4,6) is arranged to control the flow, and a pressure-limiting valve (28) in the connecting path (24–27) to limit the pressure in the chamber (15) to said predetermined maximum pressure.

2. Valve spring device according to claim 1, said connecting path (24–27) including an equalizing chamber (24).

3. Valve spring device for a valve in an internal combustion engine, said valve having a valve disc (4) which cooperates with a valve seat (5) to control the flow in a duct (3) in the engine, and a valve spindle (6) extending from said valve disc (4), the valve spring device comprising at least one spring (10,11) arranged to act between an abutment surface (12) of the engine and an actuating means (8) joined to the valve spindle (6), to bias the valve disc (4) towards the valve seat (5), characterized in that the spring (10,11) is a helical compression spring of relatively weak spring force and that the actuating means (8) is arranged around the valve spindle (6) and is axially displaceable and sealingly guided to form an essentially cylindrical chamber (15), which at one end is delimited by the spring abutment surface (12) and at the other end by the actuating means (8), said chamber (15) continuously communicating via at least one connecting path (23) with the engine duct (3) in which the valve (4,6) is arranged to control the flow.

* * * * *